US005214023A

United States Patent [19]

Aono

[11] Patent Number: 5,214,023

[45] Date of Patent: May 25, 1993

[54] THERMAL TRANSFER DYE PROVIDING MATERIAL

[75] Inventor: Toshiaki Aono, Kanagawa, Japan

[73] Assignee: Fuji Photo Film Co., Ltd., Kanagawa, Japan

[21] Appl. No.: 684,088

[22] Filed: Apr. 12, 1991

[30] Foreign Application Priority Data

Apr. 13, 1990 [JP] Japan ..... 2-96289
Jul. 27, 1990 [JP] Japan ..... 2-197607

[51] Int. Cl.[5] ..... B41M 5/035; B41M 5/38

[52] U.S. Cl. ..... 503/227; 428/195; 428/212; 428/913; 428/914

[58] Field of Search ..... 8/471; 428/195, 212, 428/913, 914; 503/227

[56] References Cited

U.S. PATENT DOCUMENTS 5,008,232 4/1991 Tanaka et al. ..... 503/227

*Primary Examiner*—B. Hamilton Hess
*Attorney, Agent, or Firm*—Sughrue, Mion, Zinn, Macpeak & Seas

[57] ABSTRACT

A thermal transfer dye providing material comprising a support having thereon at least one dye providing layer containing a dye which migrates to a thermal transfer image receiving material when heated, wherein said dye providing layer comprises an oil-soluble thermoplastic resin containing the dye dispersed in a water-soluble binder.

11 Claims, No Drawings

THERMAL TRANSFER DYE PROVIDING MATERIAL

FIELD OF THE INVENTION

The present invention relates to a thermal transfer dye providing material. In particular, the present invention relates to a thermal transfer dye-providing material which has an oil-soluble thermoplastic resin containing a dye dispersed in a water-soluble binder.

BACKGROUND OF THE INVENTION

Thermal transfer process, electrophotographic process, ink jet process, etc. are currently being investigated as techniques for obtaining color hard copies. The thermal process has advantages in that the apparatuses can easily be operated and maintained, and the apparatuses and materials for consumption are inexpensive. Accordingly, the thermal transfer process has many merits in comparison with other processes.

The thermal process can be roughly classified into two systems. In one system, a thermal transfer dye providing material comprising a base film having a heat-fusible ink layer formed thereon is heated by a thermal head to fuse said ink layer, thus making recording on a thermal transfer image receiving material. In the other system, a thermal transfer dye-providing material comprising a base film having a coloring material layer containing a thermomobile dye formed thereon is heated by a thermal head to allow the dye to thermally migrate to a thermal transfer image receiving material, thus transferring the dye to an image receiving material. In the latter thermal transfer system, the amount of the dye to be transferred can be controlled by changing the amount of energy applied to the thermal head so that gradation recording can be easily made. Hence, the latter system is particularly advantageous for carrying out high-quality full color recording.

However, thermal transfer dye providing materials used in the thermal migration type thermal recording methods have the following disadvantages.

Generally, polymers used in the thermomobile dye providing layer are only soluble in organic solvents, and hence coating solutions for the dye providing layer are dye solutions in organic solvents such as toluene. Further, apparatuses and vessels used in the preparation of the coating solutions must be cleaned with organic solvents. Hence, the apparatuses used for the preparation of coating solutions and coating apparatuses must be equipped with explosion-proof provisions. Moreover, the organic solvents are very expensive in comparison with water and hence manufacturing costs are increased. In addition, problems can arise with the health of the operators of this equipment.

JP-A-60-190389 (the term "JP-A" as used herein means an "unexamined published Japanese patent application") discloses a method wherein an aqueous ink dispersion containing a nonionic sublimable dye and a water-soluble or water-dispersed resin finely dispersed therein is coated to solve the above-mentioned problems.

In the dye providing layers prepared by this method, however, the dye exists as fine solid particles in water-soluble binders, and hence the transfer efficiency thereof is low. Therefore, it is difficult to obtain a transferred image having sufficiently high density and raw preservability. Further, there is a problem in that heat fusion can occur when water soluble saturated polyester resins are used as the water-soluble binders as described in the aforesaid JP-A-60-190389.

In the preparation of dye providing layers by using conventional organic solvent type coating solutions, the following methods have been proposed to obtain high transfer density and high sensitivity in the thermal migration type thermal transfer recording method. However, these methods have the following problems.

(1) A method wherein the concentration of the dye to the binder in the dye providing layer of the dye providing material is increased.

This method has problems in that when the dye providing material is stored over a long period of time, the dye migrates to the back side of the support or the dye and is precipitated out on the surface of the material, which causes a lowering or unevenness in the concentration of the dye.

(2) A method wherein plasticizers, such as oil in which the dye is soluble, are contained in the dye providing layer to increase the concentration of the dye.

In this method, the dyes can be prevented to some degree from being precipitated out during the storage of the dye providing material, but blocking trouble and the offset of the dye (the migration of the dye to the back side of the support) are likely to be caused. Further, since the coated film is softened, the coated film can be marred, and the heat fusion of the image receiving material to the dye providing material may occur.

Further, repeatedly transferable thermal transfer dye providing materials for use as the dye providing materials used in the aforesaid thermal migration type thermal transfer process have been proposed in JP-A-1-110194, JP-A-1-263084 and JP-A-1-272488. In the repeatedly transferable thermal transfer dye providing materials, the ink layer on the support is composed of a two or more layer structure, in which the different layers provide separate funtions, consisting of a relatively thin surface layer capable of conducting thermal transfer (i.e. an ink layer that contributes to thermal transfer) and a layer having a function capable of diffusing and feeding the dye (i.e. an ink layer as a dye supply layer).

However, the thermal transfer dye providing materials having the plural ink layer structure used in the thermal migration type thermal transfer recording method have the following problems.

It is preferred that the dye concentration in the ink layer as the dye supply layer (hereinafter referred to as (b) layer) is higher than that in the ink layer as the layer contributing to thermal transfer (hereinafter referred to as (a) layer) so that each of the functions of the two or more separate ink layers is effectively exhibited. The higher the dye concentration of the (b) layer, the more preferable. This is because it is preferred that the dye concentration of the (a) layer is kept constant to provide a constant transfer density after transfer is repeatedly conducted and the dye of the (a) layer which is consumed by transfer must be supplemented from the (b) layer.

A problem arises in that when the coating solutions for forming said ink layer are organic solvent systems, the dye is likely to diffuse between the ink layers having different dye concentrations in the lamination of the ink layers, and hence there is a difficulty in providing a sufficient difference in the dye concentration between the layers. Accordingly, there is a disadvantage that the transfer density is lowered by repeated transfer.

SUMMARY OF THE INVENTION

An object of the present invention is to provide a thermal transfer dye providing material which does not have the problems caused by using coating solutions of the dye providing materials having organic solvents and that provides a high transfer density and high sensitivity.

Another object of the present invention is to provide a thermal transfer dye providing material which does not cause the heat fusion thereof to the image receiving material during the course of thermal transfer and that has improved scratch resistance and preservability.

Still another object of the present invention is to provide a thermal transfer dye providing material which has improved manufacturability and provides high transfer density even after repeated transfer.

The above-described and other objects of the present invention have been achieved by providing a thermal transfer dye providing material comprising a support having thereon at least one dye providing layer containing a dye which migrates to a thermal transfer image receiving material when heated, wherein the dye providing layer comprises an oil-soluble thermoplastic resin containing a dye dispersed in a water-soluble binder (i.e., the dye providing layer comprises an oil-soluble thermoplastic resin containing the dye and a water-soluble binder, and the oil-soluble thermoplastic resin containing the dye is dispersed in the water-soluble binder);

a thermal transfer dye providing material comprising a support having thereon at least one dye providing layer containing a dye which migrates to a thermal transfer image receiving material when heated, wherein said dye providing layer comprises an oil-soluble thermoplastic resin containing a dye and a plasticizer dispersed in a water-soluble binder (i.e., the dye providing layer comprises an oil-soluble thermoplastic resin containing the dye and a plasticizer, and a water-soluble binder, and the oil-soluble thermoplastic resin containing the dye and the plasticizer is dispersed in the water-soluble binder; and a thermal transfer dye providing material comprising a support having thereon at least two dye providing layers, wherein at least one layer of said dye providing layers comprises an oil-soluble thermoplastic resin containing a thermomobile dye dispersed in a water-soluble binder (i.e., the dye providing layer comprises an oil-soluble thermoplastic resin containing the dye and a water-soluble binder, and the oil-soluble thermoplastic resin containing the dye is dispersed in the water-soluble binder).

In the present invention, the organic solvent solution containing an oil-soluble polymer is not coated directly as in conventional methods, but an aqueous dispersion of fine particles of an organic solvent solution of an oil-soluble thermoplastic resin containing a dye dispersed in a water-soluble binder is coated. Hence, coating can be carried out by using water as a principal solvent. Accordingly, there is no risk of explosion, the manufacturing costs can be markedly reduced and adverse effects on operator health are greatly reduced.

The present inventors have unexpectedly found that a dye providing material having a layer comprising an oil-soluble thermoplastic material containing a dye dispersed in a water-soluble binder as a dye providing layer does not cause precipitation of the dye even when stored over a long period of time, and further, the material provides a high transfer density as in the case of the present invention. In addition, heat fusion is scarcely caused when thermal transfer is carried out by using the thermal transfer dye providing material of the present invention. Further, the surface of the dye providing material of the present invention is scarcely marred during handling, and the dye providing material hardly causes blocking trouble, offset of the dye, etc. during storage.

Furthermore, techniques which are conventionally applied to the aforesaid organic solvent coating systems to obtain a high transfer density can be applied to the present invention.

DETAILED DESCRIPTION OF THE INVENTION

The term "oil-soluble thermoplastic resin" as used herein means that the oil-soluble thermoplastic resin is substantially insoluble in water.

Now, the present invention will be illustrated in more detail below.

Any dyes used in conventional thermal transfer dye providing materials can be used in the present invention. Of these, dyes having a low molecular weight of, about 150 to about 800 are particularly preferred in the present invention. Dyes to be used are chosen from among these dyes by taking transfer temperature, hue, light resistance, solubility in low-molecular organic solvents, dispersibility in water-soluble binders, etc. into consideration.

Examples of the dyes include disperse dyes, basic dyes and oil-soluble dyes. More specifically, preferred examples of the dyes include Sumikaron Yellow E4GL, Dianix Yellow H2G-FS, Miketon Polyester Yellow 3GSL, Kayazot Yellow 937, Sumikaron Red EFBL, Dianix Red ACE, Miketon Polyester Red FB, Kayazet Red 126, Miketon Fast Brilliant Blue B and Kayazet Blue 136. Other conventional thermomobile type dyes can also be used.

Further, there can be preferably used yellow dyes as described in JP-A-59-78895, JP-A-60-28451, JP-A60-28453, JP-A-60-53564, JP-A-61-148096, JP-A-60-239290, JP-A-60-31565, JP-A-60-30393, JP-A-60-53565, JP-A-60-27594, JP-A-61-262191, JP-A-60-152563, JP-A-61-244595, JP-A-62-196186, JP-A-63-142062, JP-A-63-39380, JP-A-62-290583, JP-A-63-111094, JP-A-63-111095, JP-A-63-122594, JP-A-63-71392, JP-A-63-74685, JP-A-63-74688 and EP 331170 (which describes dyes represented by formula (I)

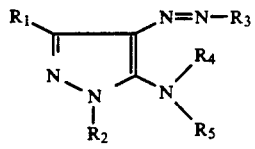

(I)

wherein $R_1$ represents a hydrogen atom, an alkyl group, an alkoxy group, an aryl group, an alkoxycarbonyl group, a cyano group or a carbamoyl group; $R_2$ represents a hydrogen atom, an alkyl group or an aryl group; $R_3$ represents an aryl group or a heterocyclic group; and $R_4$ and $R_5$ may be the same or different groups and each represents a hydrogen atom or an alkyl group. The above-described groups may be further substituted).

Magenta dyes which can be preferably used are described in JP-A-60-223862, JP-A-60-28452, JP-A-60-

31563, JP-A-59-78896, JP-A-60-31564, JP-A-60-303391, JP-A-61-227092, JP-A-61-227091, JP-A-60-30392, JP-A-60-30694, JP-A-60-131293, JP-A-61-227093, JP-A-60-159091, JP-A-61-262190, JP-A-62-33688, JP-A-63-5992, JP-A-61-12392, JP-A-62-55194, JP-A-62-297593, JP-A-63-74685, JP-A-63-74688, JP-A-62-97886, JP-A-62-132685, JP-A-61-163895, JP-A-62-211190, JP-A-62-99195 and U.S. Pat. No. 4,910,187 (which describes dyes represented by formula (II)

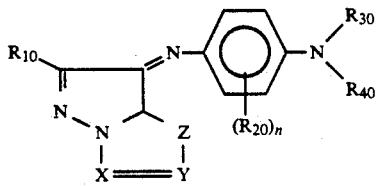

(II)

wherein $R_{10}$ and $R_{20}$ each represent a hydrogen atom, a halogen atom, an alkyl group, a cycloalkyl group, an alkoxy group, an aryl group, an aryloxy group, an aralkyl group, a cyano group, an acylamino group, a sulfonylamino group, a ureido group, an alkylthio group, an arylthio group, an alkoxycarbonyl group, a carbamoyl group, a sulfamoyl group, a sulfonyl group, an acyl group or an amino group; $R_{30}$ and $R_{40}$ each represent an alkyl group, a cycloalkyl group, an aralkyl group or an aryl group, or $R_{30}$ and $R_{40}$ may be combined together to form a ring; $R_{20}$ and $R_{30}$ or $R_{20}$ and $R_{40}$ may be combined together to form a ring; n represents an integer of 0 to 3; and X, Y and Z each represent a group of

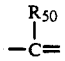

or a nitrogen atom (wherein $R_{50}$ represents a hydrogen atom, an alkyl group, a cycloalkyl group, an aralkyl group, an aryl group, an alkoxy group, an aryloxy group or an amino group); or X and Y or Y and Z are each a group of

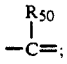

X and Y or Y and Z may be combined together to form a saturated or unsaturated carbon ring. The above-described groups may be further substituted.

Cyan dyes, which can also be preferably used, are described in JP-A-59-78894, JP-A-60-31559, JP-A-60-53563, JP-A-61-19396, JP-A-61-22993, JP-A-61-31467, JP-A-61-35994, JP-A-61-49893, JP-A-61-57651, JP-A-62-87393, JP-A-63-15790, JP-A-63-15853, JP-A-63-57293, JP-A-63-74685, JP-A-63-74688, JP-A-59-227490, JP-A-59-227493, JP-A-59-227948, JP-A-60-131292, JP-A-60-131294, JP-A-60-151097, JP-A-60-151098, JP-A-60-172591, JP-A-60-217266, JP-A-60-239289, JP-A-60-239291, JP-A-60-239292, JP-A-61-148269, JP-A-61-244594, JP-A-61-255897, JP-A-61-284489, JP-A-61-368493, JP-A-62-132684, JP-A-62-138291, JP-A-62-191191, JP-A-62-255187, JP-A-62-288656, JP-A-62-311190, JP-A-63-144089 and U.S. Pat. No. 4,983,493 (which describes dyes represented by formula (III)

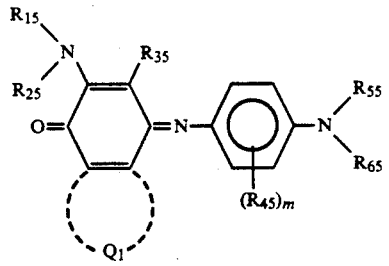

(III)

wherein $Q_1$ represents an atomic group containing at least one nitrogen atom and carbon atoms required for forming a five-membered or more-membered nitrogen-containing heterocyclic ring; $R_{15}$ represents an acyl group or a sulfonyl group; $R_{25}$ represents a hydrogen atom or an aliphatic group having 1 to 6 carbon atoms; $R_{35}$ represents a hydrogen atom, a halogen atom, an alkoxy group or an aliphatic group having 1 to 6 carbon atoms; $R_{45}$ represents a halogen atom, an alkoxy group or an aliphatic group having 1 to 6 carbon atoms; m represents an integer of 0 to 4; $R_{35}$ and $R_{15}$, $R_{35}$ and $R_{25}$ or $R_{35}$ and $R_{45}$ may be combined together to form a ring; $R_{55}$ and $R_{65}$ each represent a hydrogen atom, an aliphatic group having 1 to 6 carbon atoms or an aromatic group or $R_{55}$ and $R_{65}$ may be combined together to form a ring; or at least one of $R_{55}$ and $R_{45}$ and $R_{65}$ and $R_{45}$ may be combined together to form a ring.

Dye dissolving agents (i.e., high-boiling organic solvents or thermal solvents) for use as dispersion aids or dissolution aids for the dyes or for use as plasticizers for the oil-soluble thermoplastic resins together with the dyes can be contained in the dye providing layer (particularly in the oil-soluble thermoplastic resins) of the thermal transfer dye providing material.

Examples of the high-boiling organic solvents include compounds such as esters (e.g., phthalic esters, phosphoric esters, fatty acid esters), amides (e.g., fatty acid amides, sulfonamides), ethers, alcohols, paraffins and silicone oil described in JP-A-59-83154, JP-A-59-178451, JP-A-59-178452, JP-A-59-178453, JP-A-59-178454, JP-A-59-178455 and JP-A-59-178457.

Suitable thermal solvents include compounds having properties such that (1) they are compatible with the dyes; (2) they are solid at room temperature, but are molten (may be molten by mixing with other ingredients) when heated by a thermal head during transfer; and (3) they are not decomposed when heated by the thermal head. Compounds having a melting point of preferably 35° to 250° C., particularly preferably 35° to 200° C. and a (inorganic character/organic character) value $<1.5$ are preferred. The terms "inorganic character" and "organic character" as used herein refer to conceptions for forecasting the properties of compounds. The details thereof are described in, for example, *Region of Chemistry*, 11, page 719 (1957) (written in Japanese).

More specifically, examples of the high-boiling organic solvents and the thermal solvents include compounds described in JP-A-62-174754, JP-A-62-245253, JP-A-61-209444, JP-A-61-200538, JP-A-62-8145, JP-A-62-9348, JP-A-62-30247 and JP-A-62-136646. Specific examples of thermal solvents are shown in the following Table A.

TABLE A
| | Chemical formula | Melting point (°C.) | Inorganic character/ Organic character |
|---|---|---|---|
| (1) | $C_{16}H_{33}SO_2NH_2$ | 98 | 0.75 |
| (2) | 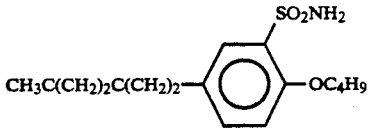 | 91 | 0.92 |
| (3) | 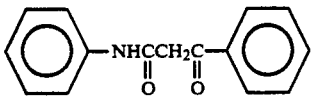 | 107 | 0.98 |
| (4) | 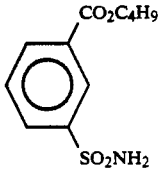 | 56 | 1.43 |
| (5) | $C_{12}H_{25}NHCONH_2$ | 105 | 0.85 |
| (6) | 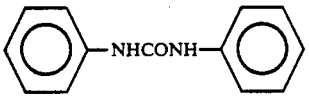 | 154 | 0.96 |
| (7) | $(n)C_{17}H_{35}COOH$ | 71 | 0.42 |
| (8) | $(n)C_{18}H_{37}OH$ | 58 | 0.28 |
| (9) | 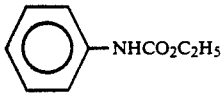 | 52 | 1.31 |
| (10) | 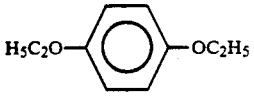 | 72 | 0.28 |
| (11) | 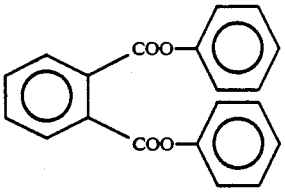 | 69 | 0.41 |
| (12) | 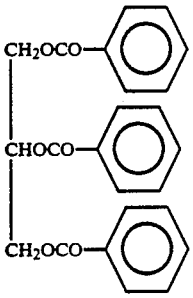 | 71 | 0.47 |

TABLE A-continued
| Chemical formula | Melting point (°C.) | Inorganic character/ Organic character |
|---|---|---|
| (13) 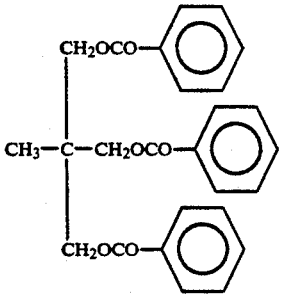 | 81 | 0.45 |
| (14) 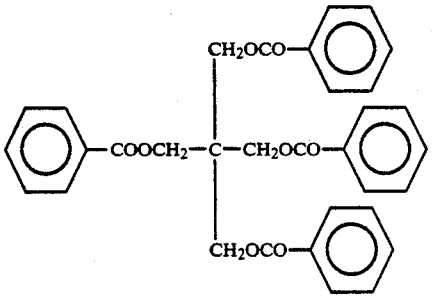 | 99 | 0.47 |
| (15) $(n)C_{15}H_{31}COO-^{(n)}C_{18}H_{37}$ | 58 | 0.09 |
| (16) 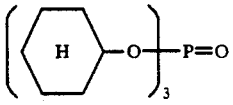 | 60 | 0.31 |
| (17) 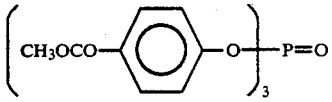 | 102 | 0.64 |
| (18) 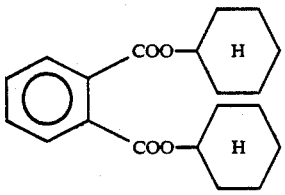 | 62 | 0.31 |
| (19) 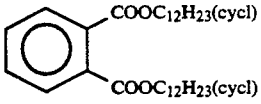 | 67 | 0.20 |
| (20) 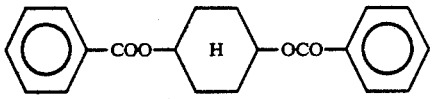 | 113 | 0.40 |
| (21) 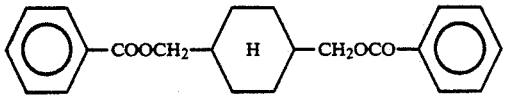 | 125 | 0.36 |
| (22) 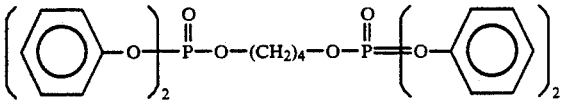 | 102 | 0.50 |

TABLE A-continued

| Chemical formula | Melting point (°C.) | Inorganic character/ Organic character |
|---|---|---|
| (23) 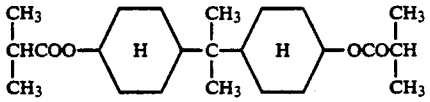 | 95 | 0.33 |
| (24) 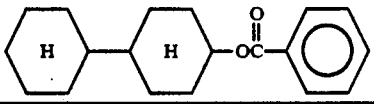 | 77 | 0.25 |

The high-boiling organic solvents and/or the thermal solvents can be used alone in a microscopically dissolved or dispersed form in the dye providing layer. However, it is preferred that they are used as a mixture with the oil-soluble thermoplastic resins containing the thermomobile type dyes.

Further, the high-boiling organic solvents may be used for the purpose of improving slipperiness, releasability and curl balance.

Various compounds can be used as the water-soluble binders used in the dye providing layer of the thermal transfer dye providing material of the present invention. However, water-soluble polymers having a group capable of crosslinking by hardening agents are preferred.

Examples of the water-soluble polymers which can be used in the present invention include vinyl polymers such as polyvinyl alcohol, polyvinyl pyrrolidone and modified polyvinyl alcohols and derivatives thereof as described in JP-A-60-145879, JP-A-60-220750, JP-A-61-143177, JP-A-61-235182, JP-A-61-245183, JP-A-61-237681 and JP-A-61-261089; polymers having acryloyl group such as polyacrylamide, polydimethylacrylamide, polydimethylamino acrylate, polyacrylic acid and salts thereof, acrylic acid methacrylic acid copolymers and salts thereof, polymethacrylic acid and salts thereof and acrylic acid vinyl alcohol copolymers and salts thereof as described in JP-A-60-168651 and JP-A-62-9988; natural polymers and derivatives thereof such as starch, oxidized starch, starch acetate, amino starch, carboxyl starch, dialdehyde starch, cationic starch, dextrin, sodium alginate, gelatin, gum arabic, casein, pullulan, dextran, methyl cellulose, ethyl cellulose, carboxymethyl cellulose, hydroxyethyl cellulose and hydroxypropyl cellulose as described in JP-A-59-174382, JP-A-60-262685, JP-A-61-143177, JP-A-61-181679, JP-A-61-193879 and JP-A-61-287782; synthetic polymers such as polyethylene glycol, polypropylene glycol, polyvinyl methyl ether, maleic acid vinyl acetate copolymers, maleic acid-N-vinyl pyrrolidone copolymers, maleic acid alkyl vinyl ethyl copolymers and polyethyleneimine as described in JP-A-61-32787, JP-A-61-237680 and JP-A-61-277483; and water-soluble polymers described in JP-A-56-58869.

Various copolymers which are made water soluble by monomers having an $SO_3^-$ group, $COO^-$ group or $SO_2^-$ group can be used.

Furthermore, water-soluble or water-dispersible polyester resins such as Plascoat Z-466, Z-488, Z-461, Z-767 and Z-771 (products of Goo Kagaku KK), Pesu Resin A-1248, A-2141 and A-2151 (products of Takamatsu Yushi KK) and Finetex ES-661, ES-650, ES-670, ES-675 and ES-850 (products of Dainippon Ink and Chemicals Inc.) can be added.

It is particularly preferred that gelatin is used as the water-soluble binder because set drying can be used and hence drying load is greatly reduced. Examples of gelatin include lime-processed gelatin, lime-processed gelatin obtained by calcium removing treatment, acid-processed gelatin, phthalated gelatin, acetylated gelatin, succinated gelatin and derivatives thereof, and enzyme-processed gelatin, hydrolyzate of gelatin and enzymatic hydrolyzate of gelatin described in *Bull. Soc. Phot. Japan.* No. 16, p. 30 (1966). These water-soluble polymers may be used either alone or in combination of two or more of them.

The oil-soluble thermoplastic resins used together with the aforesaid dyes are generally chosen from those which have high heat resistance and do not interfere with the migration of the dyes when heated. Examples of the oil-soluble thermoplastic resins which can be used in the present invention include vinyl resins such as polyamide resins, polyester resins, epoxy resins, polyurethane resins, polyacrylic resins (e.g., polymethyl methacrylate, polyacrylamide, polystyrene acrylonitrile) and polyvinyl pyrrolidone, polyvinyl chloride resins (e.g., vinyl chloride-vinyl acetate copolymer), polycarbonate resins, polystyrene, polyphenylene oxide, cellulosic resins (e.g., methyl cellulose, ethyl cellulose, carboxymethyl cellulose, cellulose acetate hydrogenphthalate, cellulose acetate, cellulose acetate propionate, cellulose acetate butyrate, cellulose triacetate), polyvinyl alcohol resins (e.g., polyvinyl alcohol, partially saponified polyvinyl alcohols such as polyvinyl butyral), petroleum resins, rosin derivatives, coumarone-indene resins, terpene resins and polyolefin resins (e.g., polyethylene, polypropylene). Polyvinyl butyral is preferably used.

The oil-soluble thermoplastic resins containing the thermomobile type dyes can be dispersed in the water-soluble binders by any conventional dispersion method for dispersing hydrophobic materials in the water-soluble polymers. Typically, a method can be used in which the thermomobile dye, and optionally, appropriate amounts of a thermal solvent and a high-boiling organic solvent are dissolved in a solution of the oil-soluble thermoplastic resin dissolved in a water-immiscible low-boiling organic solvent, and the resulting solution is emulsified and dispersed in an aqueous solution of the water-soluble binder.

Examples of the low-boiling organic solvent include ethyl acetate, n-propyl acetate, isopropyl acetate, butyl acetate, isobutyl acetate, toluene, methyl ethyl ketone, methyl isobutyl ketone, diethyl ketone, ethyl propionate, β-ethoxyethyl acetate, methyl cellosolve acetate and cyclohexanone.

The ratio (by weight) of the thermomobile type dye/-the oil-soluble thermoplastic resin used in each of the dye providing layers is generally from 0.1 to 20, preferably from 0.3 to 10, and particularly preferably from 0.5 to 6. The ratio (by weight) of (dye+oil-soluble thermoplastic resin)/water-soluble binder is generally from 0.5 to 20, preferably from 1 to 10, and particularly preferably from 2 to 6. The amount of the thermal solvent and/or the high-boiling organic solvent to be added is generally from 0 to 200 parts by weight, and preferably from 5 to 50 parts by weight per 100 parts by weight of the oil-soluble thermoplastic resin.

The dye providing layer of the dye providing material of the present invention has a thickness of preferably from 0.5 to 10 μm, and particularly preferably from 1 to 6 μm.

The obtained dispersion is coated on one side of a support (or two or more dye providing layers are simultaneously multi-layer coated) to obtain the dye providing layer of the present invention.

Any supports used for conventional thermal transfer dye providing materials can be used. Examples of the supports include polyethylene terephthalate, polyamides, polycarbonates, glassine paper, condenser paper, cellulose esters, fluoropolymers, polyethers, polyacetals, polyolefins, polyimides, polyphenylene sulfide, polypropylene, polysulfone and cellophane.

The supports of the thermal transfer dye providing materials have a thickness of generally from 2 to 30 μm and may be optionally provided with an undercoat layer. Further, a layer comprising a hydrophilic polymer for preventing the dye from being diffused may be interposed between the support and the dye providing layer, whereby the transfer density can be further improved. The above-described water-soluble polymers can be used as the hydrophilic polymer. Gelatin and polyvinyl alcohol are particularly preferred. The thickness of the water-soluble polymer layer is preferably from 0.5 to 30 μm.

A slipping layer may be provided to prevent the thermal head from sticking to the dye providing material. The slipping layer comprises a lubricating material containing a polymer binder or containing no polymer binder, for example, a surfactant containing a long-chain carbon chain, silicone, fluorine, etc., a solid or liquid lubricating agent or a mixture thereof.

The dye providing layer is formed by choosing a dye which allows a desired hue to be transferred when printed. If desired, two or more dye providing layers having different hues may be arranged on one thermal transfer dye providing material. For example, when the printing of each color is repeatedly carried out according to progressive signals to form an image such as a color photograph, it is desirable that each printed hue is formed of cyan, magenta and yellow colors, and three dye providing layers containing the dyes giving such hues are arranged. A dye providing layer containing a dye giving a black hue may be further provided in addition to the cyan, magenta and yellow colors. It is preferred that a mark for position detection is provided simultaneously with the formation of any one of the dye providing layers in the formation of these dye providing layers, because an extra inking or printing stage in addition to the formation of the dye providing layers is not required.

In another embodiment, the present invention provides a thermal transfer dye providing material comprising a support having thereon at least two dye providing layers containing a thermomobile dye, wherein at least one layer of said dye providing layers comprises an oil-soluble thermoplastic resin containing a thermomobile dye dispersed in a water-soluble binder.

In the present invention, the organic solvent solution of the thermomobile type dye is not coated, but at least one of the dye providing layers, preferably all the layers are formed by coating a dispersion of the oil-soluble thermoplastic resin containing the thermomobile type dye dispersed in a water-soluble binder. Hence, there is little diffusion of the dye between the dye providing layers laminated on the support, and the difference in the concentration of the dye between the dye providing layers can be easily obtained. Accordingly, a good transfer density can be obtained even after repeated transfer.

When all of the two or more dye providing layers comprise the oil-soluble thermoplastic resin dispersed in the water-soluble binder as described above, a coating-drying stage must be repeatedly carried out many times in the methods using conventional organic solvent coating solutions. However, the thermomobile type dye coating solution of the present invention is a water-soluble binder solution and allows multi-layer coating to be carried out simultaneously. Accordingly, the present invention has additional advantages in that the manufacturing process can be shortened, and the manufacturing cost can be reduced.

In this embodiment of the present invention, the thermal transfer dye providing material comprises a support having thereon at least two dye providing layers containing the thermomobile type dye. Specifically, the thermal transfer dye providing material has at least two dye providing layers: a dye providing layer ([a] layer) as a layer contributing to thermal transfer, for allowing the dye in a pattern form to migrate to the image receiving layer of the thermal transfer image receiving material when heat is applied and a dye providing layer ([b] layer) as the dye supply layer for supplying the thermomobile type dye to said [a] layer by diffusion.

In this embodiment of the present invention, the thermal transfer dye providing material is characterized in that at least one layer of the at least two dye providing layers comprises the oil-soluble thermoplastic resin containing the thermomobile type dye dispersed in the water-soluble binder.

Even when at least three dye providing layers are formed, the above object can be achieved by applying said water-soluble binder to at least one layer thereof (e.g., the interlayer of the three layer structure). Further, when the water-soluble binder is applied to all of the dye providing layers, multi-layer coating can be simultaneously carried out.

It is desirable that the ratio of the dye/the oil-soluble thermoplastic resin and the ratio of (the dye+the oil-soluble thermoplastic resin)/the water-soluble binder in the [b] layer are higher than those in the [a] layer and preferably at least two times higher, more preferably at least three times higher than those in the [a] layer.

The amount of dye to be coated in the [b] layer is at least two times, preferably at least 5 times that of the dye to be coated in the [a] layer. The coated thickness (dry thickness) of the [b] layer is thicker than that of the [a] layer and preferably at least twice as thick as that of the [a] layer.

With regard to the thickness of each of the dye providing layers of the dye providing material in this embodiment of the present invention, the thickness of the

[a] layer is preferably from 0.1 to 0.3 μm, particularly preferably from 0.2 to 2 μm, and that of the [b] layer is preferably from 0.5 to 20 μm, more preferably from 1 to 10 μm, and particularly preferably from 1 to 5 μm.

The obtained dispersion is coated on one side of the support or on the already coated dye providing layer (if desired, multi-layer coating is conducted) to obtain the dye providing layers of the present invention.

It is preferred that the above-described thermal solvent is applied to the [b] layer, because the concentration of the dye to be contained in the [b] layer can be increased, and the diffusion of the dye in the [a] layer during heating can be facilitated.

The thermal transfer image receiving material is provided with an image receiving layer capable of receiving a dye. The image receiving layer is a layer comprising a dye accepting substance capable of accepting the thermomobile type dye which migrates from the thermal transfer dye providing material during transfer and fixing said dye, or a layer comprising said dye accepting substance dispersed in preferably the water-soluble binder.

Typical examples of the dye accepting substance include dye accepting polymers. Examples of the dye accepting polymers include the following resins.

1. Resins having an ester linkage

Polyester resins obtained by condensing a dicarboxylic acid component such as terephthalic acid, isophthalic acid, succinic acid or the like (these dicarboxylic acid components may be substituted by sulfo group, carboxyl group, etc.) with ethylene glycol, diethylene glycol, propylene glycol, neopentyl glycol, bisphenol A or the like; polyacrylic ester resins and polymethacrylic acid ester resins such as polymethyl methacrylate, polybutyl methacrylate, polymethyl acrylate, etc.; polycarbonate resins; polyvinylacetate resins; styrene-acrylate resins; and vinyltolueneacrylate resins. Examples of these resins include those described in JP-A-59-101395, JP-A-63-7971, JP-A-63-7972, JP-A-63-7973 and JP-A-60-294862. Examples of commercially available resins which can be used in the present invention include Vylon 290, Vylon 200, Vylon 280, Vylon 300, Vylon 103, Vylon GK-140 and Vylon GK-130 (products of Toyobo co., Ltd.), ATR-2009 and ATR-2010 (products of Kao Corporation), Plascoat Z-466, Z-448, Z-455, Z-461, Z-767 and Z-771 (products of Goo Kagaku KK), Pesu Resin A-1243, A-2141 and A-2151 (products of Takamatsu Yushi KK) and Finetex ES-611, ES-650, ES-670, ES-675 and ES-850 (products of Dainippon Ink & Chemicals Inc.).

2. Resins having a urethane linkage

Polyurethane resins, etc.

3. Resins having an amido linkage

Polyamide resins, etc.

4. Resins having a urea linkage

Urea resins, etc.

5. Resins having a sulfone linkage

Polysulfone resins, etc.

6. Other resins having a linkage having high polarity

Polycaprolactone resins, styrene-maleic anhydride resins, polyvinyl chloride resins, polyacrylonitrile resins, etc.

In addition to the above-described synthetic resins, mixtures thereof and copolymers thereof can also be used.

When the image receiving layer of the thermal transfer image receiving material is formed by dispersing the dye accepting substance in the binder, examples of the binder which can be used in the present invention include the water-soluble binders and the binder resins which can be used in the dye providing layer described above.

The high-boiling point organic solvents or the thermal solvents, which can be used as the dye accepting substances or as diffusion aids for the dyes, can be contained in the thermal transfer image receiving material, particularly the image receiving layer.

The image receiving layer may be a single layer, but two or more layers may be provided. When the image receiving layer is composed of two or more layers, it is preferred that the image receiving later nearer the support is formed by using a synthetic resin having a lower glass transition point and the high-boiling organic solvent or the thermal solvent to increase affinity with the dye, while the outermost layer is formed by using a synthetic resin having a higher glass transition point, a fluorine compound and the minimum amount of the high-boiling organic solvent or the thermal solvent or without using these solvents to prevent the surface of the layer from becoming sticky, prevent the material from sticking to other materials, prevent the dye from being re-transferred to other materials after transfer or prevent problems such as the blocking of the thermal transfer dye providing material. It is preferred that release agents described hereinafter are used for the outermost layer.

The whole thickness of the image receiving layer is preferably from 0.5 to 50 μm, and particularly preferably from 3 to 30 μm. When the image receiving layer is composed of two or more layers, the thickness of the outermost layer is preferably from 0.1 to 3 μm, and particularly preferably from 0.2 to 1.5 μm.

There is no particular limitation with regard to supports used for the thermal transfer image receiving material of the present invention. Any conventional support can be used in the present invention. Materials capable of highly spreading the thermomobile type dye can be used in the present invention.

Examples of the supports which generally can be used in the present invention include (1) synthetic paper (polyolefin and polystyrene synthetic paper); (2) paper supports, preferably high quality paper, such as paper, coated paper, cast coated paper, wall paper, backing paper, synthetic resin or emulsion impregnated paper, synthetic rubber latex impregnated paper, paper containing internally synthetic resin added thereto, paperboard, cellulose fiber paper and polyolefin-coated paper (particularly paper whose both sides being covered with polyethylene); and (3) plastic films or sheets such as films or sheets of polyolefins, polyvinyl chloride, polyethylene terephthalate, polystyrene, methacrylates and polycarbonates and films or sheets obtained by treating these plastics to impart white reflecting properties.

Laminates obtained from a combination of the above (1) to (3) can also be used.

Among them, polyolefin-coated paper are preferred, because they do not cause recessed deformation by heating during thermal transfer, are excellent in whiteness and scarcely cause curling.

The details of the polyolefin-coated paper are described in, for example, *Foundation of Photographic Engineering* (section of silver salt photography), edited by Japanese Photography Society (published by Corona 1979) pages 223 to 240 (written in Japanese). The polyolefin coated paper comprises basically a support sheet and a polyolefin layer coated on the surface of the sheet. The support sheet is composed of a material other than synthetic resins. Generally, the best quality paper is used as the support sheet. A polyolefin coat may be provided by any method, so long as the polyolefin layer is closely coated on the surface of the support sheet. Generally, the polyolefin sheet is coated by means of extrusion. The polyolefin coat may be provided only on the image receiving layer side of the support sheet, but may be provided on both sides thereof, if necessary. Any of high-density polyethylene, low-density polyethylene and polypropylene can be used as the polyolefin. However, it is preferred from the viewpoint of heat insulation during transfer that low-density polyethylene having low thermal conductivity is used for the side on which the image receiving layer is provided.

Though there is no particular limitation with regard to the thickness of the polyolefin coat, the thickness thereof is preferably from 5 to 100 μm per one side. However, it is preferred that the thickness of the polyolefin coat on the image receiving layer side is thinner to obtain higher transfer density.

A pigment or a filler such as titanium oxide or ultramarine may be added to the polyolefin coat to increase whiteness. Further, a thin gelatin layer of about from 0.05 to 0.4 g/m$^2$ may be provided on the surfaces (the image receiving layer side and/or the backside thereof) of the polyolefin-coated paper.

The thermal transfer image receiving material may be provided with an interlayer with or without the water-soluble binder between the support and the image receiving layer.

The interlayer is a layer which functions as any one of a cushioning layer, a porous layer and a layer for preventing the diffusion of the dye or as any two or more of these layers depending on a material which forms the interlayer. The interlayer serves optionally as an adhesive.

The layer for preventing the diffusion of the dye plays a role in preventing the thermomobile type dye from being diffused, particularly in the support. Binders for use in forming the diffusion preventing layer may be water-soluble or organic solvent-soluble, but water-soluble binders are preferable. Examples of the water-soluble binders include those used for the above-described image receiving layer. Gelatin is particularly preferred.

The porous layer is a layer which plays a role in preventing heat applied during thermal transfer from being diffused from the image receiving layer in the support to thereby utilize applied heat effectively.

When the water-soluble polymers are used as the binder for the porous layer, the porous layer can be formed by (1) a method wherein porous fine particles are dispersed in a water-soluble polymer, and the dispersion is coated and dried; (2) a method wherein a solution of a water-soluble polymer is mechanically stirred to form bubbles, and the solution is coated and dried; (3) a method wherein a blowing agent is added to a solution of a water-soluble polymer, and the solution is foamed before coating and then coated, or foaming is made during the course of coating and drying; or (4) a method wherein an organic solvent (preferably a solvent having a boiling point higher than that of water) is emulsified and dispersed in a water-soluble polymer solution, and microvoids are formed during the course of coating and drying.

When organic solvent-soluble binders are used as the binder for the porous layer, the porous layer can be formed by (1) a method wherein an emulsion of a synthetic resin such as polyurethane or synthetic rubber latex such as methylmethacrylate-butadiene rubber latex is mechanically stirred to form bubbles, and the resulting liquid is coated on the support and dried; (2) a method wherein a blowing agent is mixed with the above-described synthetic resin emulsion or synthetic rubber latex, and the resulting mixture is coated on the support and dried; (3) a method wherein a blowing agent is mixed with vinyl chloride plastisol, a synthetic resin such as polyurethane or synthetic rubber such as styrene-butadiene rubber, and the resulting liquid is coated on the support and expanded by heating; or (4) a method wherein a solution of a thermoplastic resin or synthetic rubber in an organic solvent is mixed with a non-solvent (including a non-solvent mainly composed of water) which is difficult to evaporate in comparison with the above organic solvent, is compatable with the organic solvent and does not dissolve the thermoplastic resin or the synthetic rubber, and the resulting mixed solution is coated on the support and dried to form microporous layer.

When the image receiving layer is provided on both sides of the support, an interlayer may be provided on both sides or only on one side.

The thickness of the interlayer is preferably 0.5 to 50 μm, particularly preferably 1 to 20 μm.

The image receiving layer, the cushioning layer, the porous layer, the diffusion preventing layer and the adhesive layer of the thermal transfer image receiving material of the present invention may contain fine powders of silica, clay, talc, diatomaceous earth, calcium carbonate, calcium sulfate, barium sulfate, aluminum silicate, synthetic zeolite, zinc oxide, lithopone, titanium oxide, alumina, etc.

The thermal transfer image receiving material may contain fluorescent brighteners. Examples thereof include compounds described in K. Veenkataraman, *The Chemistry of Synthetic Dyes,* Vol. 5, Chapter 8, and JP-A-61-143752. More specifically, examples of the fluorescent brighteners include stilbene compounds, coumarin compounds, biphenyl compounds, benzoxazolyl compounds, naphthalimide compounds, pyrazoline compounds, carbostyryl compounds and 2,5-benzoxazole thiophene compounds.

The fluorescent brighteners may be used in combination with anti-fading agents.

It is preferred that release agents are contained in layers which form the dye providing material and/or the dye image receiving material, particularly the outermost layers where both materials are brought into contact with each other to improve the releasability of the thermal transfer dye providing material and the image receiving material from each other.

Any conventional release agents can be used. Examples of the release agents include solid or waxy materials such as polyethylene wax and amide wax; phosphoric ester surfactants; paraffinic oil, fluorinated oil, silicone oil and solid fine particles thereof. Silicone oil is particularly preferred.

Examples of the silicone oil include unmodified silicone oil and modified silicone oil such as carboxy-modified, amino-modified, polyether-modified, alkyl-modified and epoxy-modified silicone oil. Specific examples of modified silicone oil are described in *Technical Data of Modified Silicone Oil,* pages 6-18B, edited by Shin-Etsu Silicone KK.

It is preferred that the layers which form the thermal transfer dye providing material and the thermal transfer image receiving material of the present invention are hardened by hardening agents.

When the organic solvent-soluble polymers are hardened, hardening agents described in JP-A-61-199997 and JP-A-58-215398 can be used. Isocyanate hardening agents for the polyester resins are particularly preferred.

Hardening agents described in U.S. Pat. No. 4,678,739 (41st column), JP-A-59-116655, JP-A-62-245261 and JP-A-61-18942 are suited for the hardening of the water-soluble polymers.

More specifically, examples of the hardening agents include aldehyde hardening agents (e.g., formaldehyde, etc.), aziridine hardening agents, epoxy hardening agents

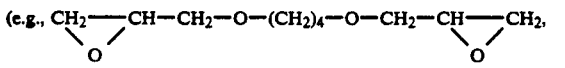

vinylsulfone hardening agents (e.g., N,N'-ethylene-bis(-vinylsulfonylacetamido)ethane, etc.), N-methylol hardening agents (e.g., dimethylol urea, etc.) and high-molecular hardening agents (e.g., compounds described in JP-A-62-234157).

The thermal transfer dye providing material and the thermal transfer image receiving material may contain anti-fading agents. Examples of the anti-fading agents include antioxidants, ultraviolet light absorbers and certain metal complexes.

Examples of the antioxidants include chroman compounds, coumaran compounds, phenol compounds (e.g., hindered phenols), hydroquinone derivatives, hindered amine derivatives and spiro-indane compounds. Further, compounds described in JP-A-61-159644 are effective.

Examples of the ultraviolet light absorbers include benztriazole compounds (described in U.S. Pat. No. 3,533,794), 4-thiazolidone compounds (described in U.S. Pat. No. 3,352,681), benzophenone compounds (described in JP-A-56-2784) and compounds described in JP-A-54-48535, JP-A-62-136641 and JP-A-61-88256. Further, ultraviolet light absorbing polymers described in JP-A-62-260152 are effective.

Examples of the metal complexes include compounds described in U.S. Pat. Nos. 4,241,155, 4,245,018 (3rd to 36th columns), and 4,254,195 (3rd to 8th columns), JP-A-62-174741, JP-A-61-88256 (pages 27 to 29) and Japanese Patent Application Nos. 62-234103, 62-31096 and 62-230596.

Examples of useful anti-fading agents are described in JP-A-62-215272 (pages 125 to 137).

To prevent the dyes transferred to the image receiving material from being faded, the anti-fading agents may be previously contained in the image receiving material, or may be added to the image receiving material from external sources, for example, by transferring the agents from the dye providing material.

The above-described antioxidants, ultraviolet light absorbers and metal complexes may be used in combination.

The thermal transfer dye providing material and the thermal transfer image receiving material may contain matting agents. Examples of the matting agents include silicon dioxide, compounds such as polyolefins and polymethacrylates described in JP-A-61-88256 (p. 29) and compounds such as benzoguanamine resin beads, polycarbonate resin beads and AS resin beads.

The constituent layers of the thermal transfer dye providing material and the thermal transfer image receiving material may contain various surfactants as a coating aid or to improve releasability and slipperiness or to impart anti-static properties.

Examples of the surfactants include nonionic surfactants, anionic surfactants, amphoteric surfactants and cationic surfactants. Examples of these surfactants are described in JP-A-62-173463 and JP-A-62-183457.

In the present invention, the thermal transfer dye providing material is put on the thermal transfer image receiving material. Thermal energy corresponding to image information is applied thereto from any one side, preferably from the back of the thermal transfer dye providing material by a heating means such as a thermal head, whereby the dye in the dye providing material can be transferred to the thermal transfer image receiving material according to the intensity of heating energy. In this way, a color image having excellent clarity and resolvable gradation can be obtained.

Examples of the heating means which can be used in the present invention include a thermal head and other conventional heating means such as a laser beam (e.g., semiconductor laser), infrared flash and thermal pen.

The present invention can be applied to printing using various thermal transfer system printers (e.g., facsimile, print preparation using a magnetic recording system, a magneto-optical recording system and optical recording system, print preparation from a CRT screen and televisions) by combining the thermal transfer dye providing material with the thermal transfer image receiving material.

Details of the thermal transfer recording method are described in JP-A-60-34895.

The present invention is now illustrated in greater detail by reference to the following examples which, however, are not to be construed as limiting the present invention in any way.

EXAMPLE 1

Preparation of dispersion A of the thermoplastic resin containing thermomobile dye.

| | |
|---|---|
| Composition of Solution I | |
| 10 wt % aqueous gelatin solution | 5 g |
| Sodium dodecylbenzenesulfonate (5 wt % aqueous solution) | 5 ml |
| Water | 20 ml |
| Composition of Solution II | |
| Polyvinyl butyral 5000A (a product of Denki Kagaku KK) | 0.5 g |
| Toluene | 10 ml |
| Methyl ethyl ketone | 10 ml |
| Thermomobile dye D-1 | 1.25 g |
| Diphenyl phthalate | 0.3 g |
| Amino-modified silicone oil (KF857, a product of Shin-Etsu Silicone KK) | 0.2 g |
| Thermomobile dye D-1 | |

-continued

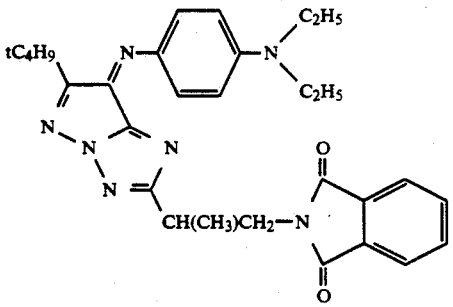

Solution II was emulsified and dispersed in Solution I in a homogenizer to prepare a dispersion A of the thermoplastic resin containing the thermomobile dye.

Preparation of Thermal Transfer Dye Providing Material 101

A polyethylene terephthalate film (Lumirar, product of Toray Industries, Inc.) having a thickness of 4.5 μm, provided with a heat-resistant slipping layer comprising a thermosetting acrylic resin on one side thereof was used as a support. A gelatin layer of 0.5 μm, in dry thickness was provided on the side of the support that is opposite to the heat-resistant slipping layer. A coating composition (A) having the following composition for forming a thermal transfer dye providing layer was then coated on the gelatin layer of the support in such an amount as to give a dry thickness of 1.5 μm, thus forming a thermal transfer dye providing layer. The back of the support was coated with a slipping layer comprising 0.45 g/m$^2$ of polyvinyl butyral (Butobar 76, a product of Monsanto Chemical Co.) and 0.3 g/m$^2$ of poly(vinyl stearate) from a tetrahydrofuran solution to prepare a thermal transfer dye providing material 101.

| Coating Composition (A) for Forming Thermal Transfer Dye Providing Layer | |
|---|---|
| Dispersion A | 50 g |
| Fluorine-containing surfactant (3) (5 wt % aqueous solution) | 1 ml |
| Crosslinking agent (2) (4 wt % aqueous solution) | 0.5 ml |

Crosslinking agent (2)

1,2-bis(vinylsulfonylacetamido)ethane

Fluorine-containing surfactant (3)

$$C_8F_{17}SO_2N(C_3F_7)\text{-}(CH_2CH_2O)_4\text{-}(CH_2)_4SO_4Na$$

Preparation of Thermal Transfer Dye Providing Material 102

A thermal transfer dye providing material 102 was prepared in the same way as in the preparation of the thermal transfer dye providing material 101 except that the following coating composition (B) was used in place of the coating composition (A) for forming the thermal transfer dye providing layer.

| Coating Composition (B) for Forming Thermal Transfer Dye Providing Layer | |
|---|---|
| Thermomobile dye D-1 | 4 g |
| Polyvinyl butyral resin (Denka Butyral 5000A, product of Denki Kagaku KK) | 4 g |
| Methyl ethyl ketone | 40 ml |
| Toluene | 40 ml |
| Polyisocyanate (Takenate, a product of Takeda Chemical Industries, Ltd.) | 0.2 g |

Preparation of Thermal Transfer Dye Providing Material 103

A thermal transfer dye providing material 103 was prepared in the same way as in the preparation of the thermal transfer dye providing material 101 except that the following coating composition (C) was used in place of the coating composition (A) for forming thermal transfer dye providing layer.

Preparation of Coating Composition (C) for Forming Thermal Transfer Dye Providing Layer 10 g of thermomobile dye D-1 was finely dispersed in 40 ml of water in the presence of 3 g of sodium dodecylbenzenesulfonate in a sand grinding mill. The resulting fine dispersion was mixed with 50 g of an aqueous saturated polyester resin (Pesu Resin A-1243, a product of Takamatsu Yushi KK; adjusted to 20 wt% solid content) to prepare an aqueous coating composition (C) for forming thermal transfer dye providing layer.

Preparation of Thermal Transfer Dye Providing Material 104

A thermal transfer dye providing material 104 was prepared in the same way as in the preparation of the thermal transfer dye providing material 103 except that gelatin was used in place of the aqueous saturated polyester resin.

Preparation of Thermal Transfer Image Receiving Material

Synthetic paper (YUPO-FPG-150, a product of Oji Yuka KK) of 150 μm in thickness was used as a base. The surface thereof was coated with the following coating composition (1) for forming the image receiving layer in such an amount as to give a dry thickness of 8 μm to form a thermal transfer image receiving material R-1 Coating was carried out by means of wire bar coating. Drying was carried out in an oven at 100° C. for 30 minutes after predrying in a dryer.

| Coating Composition (1) for Image Receiving Layer | |
|---|---|
| Polyester resin (Vylon-280, a product of Toyobo Co., Ltd.) | 22 g |
| Polyisocyanate (KP-90, a product of Dainippon Ink & Chemicals Inc.) | 4 g |
| Amino-modified silicone oil (KF-857, a product of Shin-Etsu Silicone KK) | 0.5 g |
| Methyl ethyl ketone | 85 ml |
| Toluene | 85 ml |
| Cyclohexanone | 15 ml |

Each of the thermal transfer dye providing materials 101 to 104 obtained above was placed on the thermal transfer image receiving material R-1 in such a manner that the dye providing layer and the image receiving layer were brought into contact with each other. A thermal head was used from the support side of the thermal transfer dye providing material, and thermal transfer was conducted under such conditions that thermal head output was 0.28 w/dot, pulse width was 0.15 to 15 msec and dot density was 6 dots/mm to fix an imagewise magenta dye to the image receiving layer of the thermal transfer image receiving material. Reflection density was measured by an optical densitometer using a status A filter. The results are shown in Table 1.

Further, after the above thermal transfer dye providing materials 101 to 104 were stored in a constant temperature bath at 60° C. for one week, the coated surfaces thereof were inspected with an optical microscope to examine the precipitation of the dye crystal. Further, the stored samples were used in combination with the thermal transfer image receiving material R-1, and thermal transfer was conducted in the same way as described above to evaluate the uniformity of the transferred image. All of the samples which caused the precipitation of the crystal were inferior in the uniformity of the image. The results are shown in Table 1. Further, the results of the heat fusion of the dye providing materials to the image receiving sheet R-1 are also shown in Table 1.

| Evaluation | |
|---|---|
| Raw preservability | Heat fusion |
| A: uniform | A: not fused |
| B: between A and C | B: slightly fused |
| C: non-uniform | C: fused |

TABLE 1

| Dye Providing Material No. | Maximum Density (Dmax) | Raw Preservability (Uniformity of Image) | Heat Fusion |
|---|---|---|---|
| 101 (Invention) | 2.63 | A | A |
| 102 (Comp. Ex.) | 2.19 | B | B |
| 103 (Comp. Ex.) | 1.58* | could not be evaluated | C |
| 104 (Comp. Ex.) | 1.09 | C | A |

*The fused dye providing layer (ink) was peeled off and density was measured.

It is apparent from the above results that the thermal transfer dye providing material 101 of the present invention gives a high transfer density, is excellent in raw preservability and does not cause heat fusion.

EXAMPLE 2

Preparation of dispersion E of the thermoplastic resin containing thermomobile dye.

| | |
|---|---|
| Composition of Solution I | |
| 10 wt % aqueous gelatin solution | 5 g |
| Sodium dodecylbenzesulfonate (5 wt % aqueous solution) | 5 ml |
| Water | 20 ml |
| Composition of Solution II | |
| Polyvinyl butyral 5000A (a product of Denki Kagaku KK) | 0.5 g |
| Toluene | 10 ml |
| Methyl ethyl ketone | 10 ml |
| Thermomobile dye D-2 | 1.0 g |
| Dicyclohexyl phthalate | 0.3 g |
| Epoxy polyether-modified silicone oil (SF-8421, a product of Toray Silicone KK) | 0.2 g |
| Thermomobile dye D-2 | |

-continued

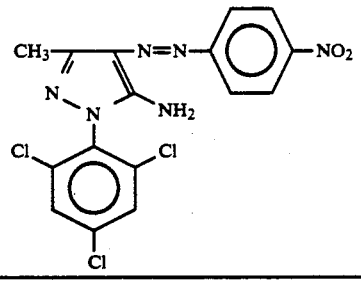

Solution II was emulsified and dispersed in Solution I in a homogenizer to prepare a dispersion E of the thermoplastic resin containing the thermomobile dye.

Preparation of Thermal Transfer Dye Providing Material

A polyethylene terephthalate film (a product of Teijin Ltd.) having a thickness of 6 μm, provided with a heat-resistant slipping layer on the back thereof was used as a support. The surface of the support was coated with the following coating composition (E) for forming the thermal transfer dye providing layer in such an amount as to give a dry thickness of 1.5 μm to prepare a thermal transfer dye providing material 201. Coating was carried out by means of wire bar coating.

| Coating Composition E for Forming The Thermal Transfer Dye Providing Layer | |
|---|---|
| Dispersion E | 50 g |
| Fluorine-containing surfactant (3) (5 wt % aqueous solution) | 1 ml |
| Crosslinking agent (2) (4 wt % aqueous solution) | 0.5 ml |

Preparation of Thermal Transfer Dye Providing Material 202

A thermal transfer dye providing material 202 was prepared in the same way as in the preparation of the thermal transfer dye providing material 201 except that a thermomobile dye D-3 was used in place of the thermomobile dye D-2.

Thermomobile dye D-3

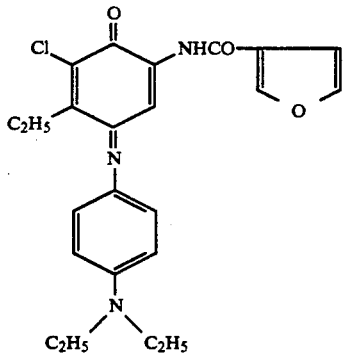

Preparation of Thermal Transfer Dye Providing Material 203 and 204

Thermal transfer dye providing materials 203 and 204 was prepared in the same way as in the preparation of the thermal transfer dye providing material 201 of Example 1 except that thermomobile dyes D-2 and D-3 were used in place of the thermomobile dye D-1, respectively.

Preparation of Thermal Transfer Dye Providing Material 205 and 206

Thermal transfer dye providing materials 205 and 206 was prepared in the same way as in the preparation of the thermal transfer dye providing material 103 of Example 1 except that Plascoat Z-488 (a product of Goo Kagaku KK) was used in place of the aqueous saturated polyester resin (Pesu Resin A-1243) and thermomobile dyes D-2 and D-3 were used in place of the thermomobile dye D-1, respectively.

Preparation of Thermal Transfer Dye Providing Material 207 and 208

Thermal transfer dye providing materials 207 and 208 was prepared in the same way as in the preparation of the thermal transfer dye providing material 104 of Example 1 except that thermomobile dyes D-2 and D-3 were used in place of the thermomobile dye D-1, respectively.

The thus-obtained thermal transfer dye providing materials were evaluated by carrying out thermal transfer in the same way as in Example 1. The results are shown in Table 2. The evaluation was carried out in the same manner as in Example 1.

It is apparent from Table 2 that the thermal transfer dye providing materials of the present invention do not cause heat fusion, have good preservability and give high transfer density.

TABLE 2

| Dye Providing Material No. | Maximum Density (Dmax) | Raw Preservability (Uniformity of Image) | Heat Fusion |
|---|---|---|---|
| 201 (Invention) | 2.60 | A | A |
| 202 (Invention) | 2.69 | A | A |
| 203 (Comparison) | 2.30 | B | A |
| 204 (Comparison) | 2.35 | B | A |
| 205 (Comparison) | 1.43* | could not be evaluated | C |
| 206 (Comparison) | 1.68* | could not be evaluated | C |
| 207 (Comparison) | 1.10 | C | A |
| 208 (Comparison) | 1.20 | C | A |

*The fused dye providing layer (ink) was peeled off and density was measured.

EXAMPLE 3

Thermal transfer dye providing materials 301 to 304 were prepared in the same way as in the preparation of the thermal transfer dye providing material 101 of Example 1 except that diphenyl phthalate was used in the amounts indicated in Table 3.

Further, thermal transfer dye providing materials 305 to 308 were prepared in the same way as in the preparation of the thermal transfer dye providing material 102 of Example 1 except that diphenyl phthalate in the amounts indicated in Table 3 was added to the coating composition (B) for forming the thermal transfer dye providing layer.

A thermal transfer image receiving material R-2 was prepared in the same way as in the preparation of the thermal transfer image receiving material R-1 of Example 1 except that paper having a basis weight of 180 g/m$^2$ (both sides thereof being laminated with polyethylene (PE thickness, surface: 18 $\mu$m, back: 30 $\mu$m) containing titanium oxide pigment dispersed therein) was used as the support in place of the synthetic paper.

Thermal transfer was carried out in the same way as in Example 1 by using the dye providing materials 301 to 308 and the image receiving material R-2 to evaluate the performances thereof. The results are shown in Table 3.

It can be seen from Table 3 that when the thermal solvent (diphenyl phthalate) is added to the samples using only the oil-soluble binder (butyral resin), blocking troubles and heat fusion are liable to be caused during storage, while the dye providing materials of the present invention cause neither blocking troubles nor heat fusion and provide high transfer density.

TABLE 3

| Dye Providing Material No. | Amount** of Diphenyl Phthalate Added | Density (Dmax) | Blocking Resistance | Heat Fusion |
|---|---|---|---|---|
| 301 (Invention) | — | 2.18 | A | A |
| 302 (Invention) | 5 | 2.22 | A | A |
| 303 (Invention) | 10 | 2.31 | A | A |
| 304 (Invention) | 20 | 2.40 | A | A |
| 305 (Comp. Ex.) | — | 1.93 | A | B |
| 306 (Comp. Ex.) | 5 | 1.95* | B | B |
| 307 (Comp. Ex.) | 10 | 2.29* | C | B |
| 308 (Comp. Ex.) | 20 | 2.42* | C | C |

Evaluation

| Blocking Resistance | Heat Fusion |
|---|---|
| A: good | A: not fused |
| B: fair | B: slightly fused |
| C: poor | C: fused |

**Amount of diphenyl phthalate added: wt % based on the amount of (polyvinylbutyral resin + thermomobile dye)

EXAMPLE 4

Preparation of dispersion A of thermoplastic resin containing thermomobile dye

| | |
|---|---|
| **Composition of solution I** | |
| 10 wt% aqueous gelatin solution | 5 g |
| Sodium dodecylbenzenesulfonate (5 wt % aqueous solution) | 5 ml |
| Water | 20 ml |
| **Composition of solution II** | |
| Polyvinyl butyral 5000A (a product of Denki Kagaku KK) | 0.5 g |
| Toluene | 10 ml |
| Methyl ethyl ketone | 10 ml |
| Thermomobile dye D-1 | 1.0 g |
| Amino-modified silicone oil (KF 857, a product of Shin-Etsu Silicone KK) | 0.2 g |

Solution II was emulsified and dispersed in solution I in a homogenizer to prepare the dispersion A of the thermoplastic resin containing the thermomobile dye.

Preparation of dispersion B of thermoplastic resin containing thermomobile dye

| | |
|---|---|
| **Composition of solution I** | |
| The same as that of the dispersion A | |
| **Composition of solution II** | |
| Polyvinyl butyral (Denka Butyral 5000A, a product of Denki Kagaku KK) | 0.5 g |
| Toluene | 10 ml |
| Methyl ethyl ketone | 10 ml |
| Thermomobile dye D-1 | 2 g |
| Diphenyl phthalate | 0.5 g |

-continued

| | |
|---|---|
| Amino-modified silicone oil | 0.2 g |

Solution II was emulsified and dispersed in solution I in a homogenizer to prepare the dispersion B of the thermoplastic resin containing the thermomobile dye.

Preparation of thermal transfer dye providing material 401

A polyethylene terephthalate film (Lumirar, a product of Toray Industries, Inc.) having a thickness of 4.5 μm, provided with a heat-resistant slipping layer comprising a thermosetting acrylic resin on one side thereof was used a support. The opposite side of the support to the heat-resistant slipping layer was coated with the following coating compositions (B) and (A) for forming thermal transfer dye providing layers (b) and (a) in an amount so as to give the (b) layer a dry thickness of 5 μm and give the (a) layer a dry thickness of 0.5 μm. The back of the support was coated with a slipping layer comprising 0.45 g/m$^2$ of polyvinyl butyral (Butobar 76, a product of Monsanto chemical Co.) and 0.3 g/m$^2$ of poly (vinyl stearate) from a tetrahydrofuran solution to prepare a thermal transfer dye providing material 401.

| Coating composition (B) for forming the thermal transfer dye providing layer ((b) layer) | |
|---|---|
| Dispersion B | 50 g |
| Crosslinking agent (2) (4 wt % aqueous solution) | 0.5 ml |
| **Coating composition (A) for forming the thermal transfer dye providing later ((a) layer)** | |
| Dispersion A | 50 g |
| Fluorine-containing surfactant (3) (5 wt % aqueous solution) | 1 ml |
| Crosslinking agent (2) | 0.5 ml |

Preparation of thermal transfer dye providing material 402

A thermal transfer dye providing material 402 was prepared in the same way as in the preparation of the thermal transfer dye providing material 401 except that only the coating composition (A) was coated in such an amount as to give a dry thickness of 10 μm, instead of using both the coating compositions (A) and (B) for forming the thermal transfer dye providing layers (a) and (b).

Preparation of thermal transfer dye providing material 403

A thermal transfer dye providing material 403 was prepared in the same way as in the preparation of the thermal transfer dye providing material 401 except that 1 ml of a 5 wt% aqueous solution of the fluorine-containing surfactant (3) was added to the coating composition (B) and the resulting composition was coated in such an amount as to give a dry thickness of 5 μm, instead of using both the coating compositions (A) and (B) for forming the thermal transfer dye providing layers (a) and (b).

Preparation of thermal transfer dye providing material 404

A polyethylene terephthalate film (Lumirar, a product of Toray industries, Inc) having a thickness of 4.5 μm, provided with a heat-resistant slipping layer comprising an acrylic resin on one side thereof was used as a support. The opposite side of the support to the heat-resistant slipping layer was coated with the following coating composition (A)' for forming thermal transfer dye providing layer in such an amount as to give a dry thickness of 5 μm. Coating was conducted by means of wire bar coating. The back of the support was coated with a slipping layer comprising 0.45 g/m$^2$ of polyvinyl butyral (butobar, a product of Monsanto Chemical Co.) and 0.3 g/m$^2$ of poly (vinyl stearate) from a tetrahydrofuran solution to prepare a thermal transfer dye providing material 404.

| Coating composition (A)' for forming thermal transfer dye providing layer | |
|---|---|
| Thermomobile dye D-1 | 4 g |
| Polyvinyl butyral resin (Denka Butyral 5000A, a product of Denki Kagaku KK) | 4 g |
| Methyl ethyl ketone | 40 ml |
| Toluene | 40 ml |
| Polyisocyanate (Takenate D110N, a product of Takeda Chemical Industries, Ltd.) | 0.2 ml |
| **Preparation of dye accepting polymer emulsion A** | |
| **Composition of solution I** | |
| Aqueous gelatin solution (10 wt %) | 100 g |
| Sodium dodecylbenzenesulfonate (5 wt % aqueous solution) | 50 ml |
| Water | 50 ml |
| **Composition of solution II** | |
| Polyester resin (Polyestor TP 220, a product of Nippon Synthetic Chemical Industry Co., Ltd.) | 30 g |
| Toluene | 60 g |
| Methyl ethyl ketone | 60 g |
| Thermal solvent A | 9 g |

After the preparation of solution II, solution I was added to solution II with stirring and the emulsifying dispersion of the mixture was carried out in a homogenizer at 15000 rmp for 9 minutes to prepare a dye accepting polymer emulsion A.

| Thermal solvent A | |
|---|---|
| diphenyl phthalate (DPP) | |
| **Preparation of dye accepting polymer emulsion B** | |
| **Composition of Solution I** | |
| Water-soluble binder (1) | 100 g |
| Sodium dodecylbenzenesulfonate (5 wt % aqueous solution) | 50 ml |
| Water | 50 ml |
| **Composition of Solution II** | |
| Polyester resin (Polyestor TP-220) | 30 g |
| Toluene | 60 g |
| Methyl ethyl ketone | 60 g |
| Crosslinking agent (1) | 4.5 g |
| Thermal solvent A | 4.5 g |
| Epoxy-modified silicone oil (KF-100T, a product of Shin-Etsu Silicone KK) | 4.5 g |

In the above composition, a 10 wt% aqueous solution of polyvinyl alcohol (PVA, a degree of saponification: 98%, a degree of polymerization: 2000) was used as the water-soluble binder (1), and polyisocyanate (KP-90, a product of Dainippon Ink & Chemicals Inc.) was used as the crosslinking agent (1).

After solutions I and II were thoroughly dissolved, solution II was added to solution I with stirring, and the emulsifying dispersion of the mixture was carried out in a homogenizer at 15,000 rpm for 9 minutes to prepare a dye accepting polymer emulsion B.

Preparation of coating solution for thermal transfer image receiving material

| | |
|---|---|
| First layer | |
| Gelatin (10 wt % aqueous solution) | 100 g |
| Water | 40 g |
| Hardening agent (4 wt % aqueous solution) (1,2-bis(vinylsulfonylacetamido)ethane) | 60 ml |
| Second layer | |
| Dye accepting polymer emulsion A | 100 g |
| Water | 50 ml |
| Third layer (outermost layer) | |
| Dye accepting polymer emulsion B | 100 g |
| Water | 50 ml |
| Fluorine-containing surfactant (3) (5% solution) (water/methanol = 1/1 by volume) | 6 ml |

Preparation of thermal transfer image receiving materials R-3 and R-4

Paper having a basis weight of 180 g/m$^2$ (both sides thereof being laminated with polyethylene (PE thickness: 30 μm) containing titanium oxide dispersed therein) was used as a support. The support was coated with the above-described first layer through third layer in such an amount as to give the wet thicknesses of 20, 60 and 15 ml/m$^2$, respectively. The coated support was dried to prepare a thermal transfer image receiving material R-3 as shown in Table 4.

The same support as that used for the thermal transfer image receiving material R-3 was coated with the following coating composition A in such an amount as to give a dry thickness of 10 μm. The coated support was dried at 80° C. for 5 minutes and at 100° C. for 30 minutes to prepare a thermal transfer image receiving material R-4.

| Coating composition A | |
|---|---|
| Polyester resin (Polyester TP-220) | 20 g |
| Toluene | 100 ml |
| Methyl ethyl ketone | 100 ml |
| Amino-modified silicone oil (KF-857, a product of Shin-Etsu Silicone KK) | 3 g |
| Crosslinking agent (1) | 3 g |

The thus-obtained thermal transfer dye providing material and thermal transfer image receiving material indicated in Table 4 below were placed on each other in such a way that the dye providing layer and the image receiving layer were brought into contact with each other. A thermal head was used from the support side of the thermal transfer dye providing material, and thermal transfer was carried out under such conditions that thermal head output was 0.28 w/dot, pulse width was 0.15 to 15 msec and dot density was 6 dots/mm, whereby a magenta dye was imagewise fixed to the image receiving layer of the thermal transfer image receiving material. Further, thermal transfer was repeatedly carried out in the same way as that described above by using the thermal transfer dye providing materials and the image receiving materials to examine the dependence of transfer density on the number of times of transfer. The results are shown in Table 4.

TABLE 4

| Thermal Transfer Dye Providing Material | Thermal Transfer Image Receiving Material | Dmax (Maximum Transfer Density) 1st Time | 2nd Time | 3rd Time |
|---|---|---|---|---|
| 401 (Invention) | R-3 | 2.53 | 2.55 | 2.48 |
| 402 (Comp. Ex.) | " | 2.32 | 2.05 | 1.65 |
| 403 (Comp. Ex.) | " | 2.98 | 1.93 | 1.35 |
| 404 (Comp. Ex.) | " | 2.83 | 2.11 | 1.51 |
| 401 (Invention) | R-4 | 2.60 | 2.58 | 2.55 |
| 402 (Comp. Ex.) | R-4 | 2.44 | 2.09 | 1.70 |
| 403 (Comp. Ex.) | R-4 | 2.95 | 1.94 | 1.43 |
| 404 (Comp. Ex.) | R-4 | 2.90 | 2.03 | 1.48 |

It is apparent from the above results that even when the dye providing materials of the present invention are repeatedly subjected to thermal transfer, transfer density is scarcely lowered.

EXAMPLE 5

A thermal transfer dye providing material 501 was prepared in the same way as in the preparation of the thermal transfer dye providing material 401 of Example 4 except that ethyl cellulose was used in place of polyvinyl butyral, which was the thermoplastic resin for dissolving the thermomobile dye, and the thermomobile dye D-2 was used in place of the thermomobile dye D-1.

The dye providing material was used in combination with the thermal transfer image material R-4 prepared in Example 4, and thermal transfer was repeatedly carried out in the same was as in Example 4. Transfer density of the first time to the third time was 2.88, 2.85 and 2.83. Accordingly, it was found that transfer density was scarcely lowered.

While the invention has been described in detail and with reference to specific embodiments thereof, it will be apparent to one skilled in the art that various changes and modifications can be made therein without departing from the spirit and scope thereof.

What is claimed is:

1. A thermal transfer dye providing material comprising a support having thereon at least one dye providing layer containing a thermomobile dye which migrates to a thermal transfer image receiving material when heated, wherein said dye providing layer comprises an oil-soluble thermoplastic resin containing said dye and a water-soluble binder and said oil-soluble thermoplastic resin containing said dye is dispersed in said water-soluble binder.

2. A thermal transfer dye providing material as in claim 1, wherein a layer comprising a water-soluble polymer is provided between the support and the dye providing layer.

3. A thermal transfer dye providing material as in claim 1, wherein said dye providing material has at least two dye providing layers and at least one layer of said dye providing layers comprises an oil-soluble thermoplastic resin containing a thermomobile dye and a water-soluble binder and said oil-soluble thermoplastic resin containing a thermomobile dye is dispersed in said water-soluble binder.

4. A thermal transfer dye providing material as in claim 3, wherein all of said dye providing layers comprises an oil-soluble thermoplastic resin containing a thermomobile dye and a water-soluble binder and said oil-soluble thermoplastic resin containing a thermomobile dye is dispersed in said water-soluble binder.

5. A thermal transfer dye providing material as in claim 3, wherein said material has at least two dye providing layers and at least the layer nearer the support comprises an oil-soluble thermoplastic resin containing a thermomobile dye and a dye-dissolving agent, and a water-soluble binder, and said oil-soluble thermoplastic resin containing a thermomobile dye and a dye-dissolving agent is dispersed in said water-soluble binder.

6. A thermal transfer dye providing material as in claim 1, wherein the thermomobile dye has a molecular weight of about 150 to about 800.

7. A thermal transfer dye providing material as in claim 1, wherein the oil-soluble thermoplastic resin is a polyamide resin, polyester resin, epoxy resin, polyurethane resin, polyacrylic resin, vinyl resin, polycarbonate resin, polystyrene, polyphenylene oxide resin, cellulosic resin, petroleum resin, rosin, coumarone-indene resin, terpene resin or polyolefin resin.

8. A thermal transfer dye providing material as in claim 1, wherein the water soluble binder is a water-soluble polymer.

9. A thermal transfer dye providing material as in claim 8, wherein the water soluble binder is gelatin.

10. A thermal transfer dye providing material as in claim 1, wherein the ratio by weight of thermomobile dye to oil-soluble thermoplastic resin used in each of the dye providing layers is from 0.1 to 20.

11. A thermal transfer dye providing material comprising a support having thereon at least one dye providing layer containing a thermomobile dye which migrates to a thermal transfer image receiving material when heated, wherein said dye providing layer comprises an oil-soluble thermoplastic resin containing said dye and a plasticizer, and a water-soluble binder, and said oil-soluble thermoplastic resin containing said dye and said plasticizer is dispersed in said water-soluble binder.

* * * * *